US008721292B2

(12) United States Patent
McLaughlan et al.

(10) Patent No.: US 8,721,292 B2
(45) Date of Patent: May 13, 2014

(54) GAS-TURBINE BLADE ROOT

(75) Inventors: James McLaughlan, Derby (GB); Roger Ashmead, Derby (GB)

(73) Assignee: Rolls-Royce Deutschland Ltd & Co KG (DE)

( * ) Notice: Subject to any disclaimer, the term of this patent is extended or adjusted under 35 U.S.C. 154(b) by 867 days.

(21) Appl. No.: 12/289,625

(22) Filed: Oct. 30, 2008

(65) Prior Publication Data

US 2009/0185910 A1 Jul. 23, 2009

(30) Foreign Application Priority Data

Oct. 30, 2007 (DE) ..... 10 2007 051 838

(51) Int. Cl.
*F03B 3/12* (2006.01)

(52) U.S. Cl.
USPC ..... 416/215; 416/248; 416/244 A; 416/216

(58) Field of Classification Search
USPC ..... 416/248, 244 A, 215, 216
See application file for complete search history.

(56) References Cited

U.S. PATENT DOCUMENTS

| | | | | |
|---|---|---|---|---|
| 4,453,890 | A | 6/1984 | Brantley | |
| 5,299,353 | A * | 4/1994 | Nazmy et al. | 29/889.7 |
| 5,554,005 | A * | 9/1996 | Nguyen | 416/219 R |
| 2003/0194319 | A1 * | 10/2003 | Zabawa et al. | 416/2 |
| 2004/0064945 | A1 * | 4/2004 | Howley | 29/889.7 |
| 2007/0014667 | A1 * | 1/2007 | Pickens et al. | 416/193 A |
| 2009/0136356 | A1 * | 5/2009 | Beckford et al. | 416/239 |

FOREIGN PATENT DOCUMENTS

| | | | | |
|---|---|---|---|---|
| EP | 874136 | | 10/1998 | |
| EP | 1355044 | | 10/2003 | |
| GB | WO 2007/045815 | * | 4/2007 | F01D 5/30 |

OTHER PUBLICATIONS

German Search Report dated Mar. 12, 2012 from counterpart foreign application.

* cited by examiner

*Primary Examiner* — Zandra Smith
*Assistant Examiner* — Jamie C Niesz
(74) *Attorney, Agent, or Firm* — Timothy J. Klima; Shuttleworth & Ingersoll, PLC

(57) ABSTRACT

A gas-turbine blade root 1 has at least two essentially rectangularly adjoining surfaces 4, 5 for locating the gas-turbine blade root 1 and a transition area of the surfaces 4, 5 includes a bevelled, plane edge 6.

12 Claims, 3 Drawing Sheets

GAS-TURBINE BLADE ROOT

This application claims priority to German Patent Application DE102007051838.4 filed Oct. 30, 2007, the entirety of which is incorporated by reference herein.

The present invention relates to a gas-turbine blade root. More particularly, the present invention relates to a gas-turbine blade root with at least two essentially rectangularly adjoining surfaces for locating the gas-turbine blade root.

Gas-turbine blade roots are usually contoured to be positively fixed in disks. The contour may have a great variety of forms. In manufacture according to the state of the art, the edges formed between the surfaces, or at the transition and border of the surfaces, are manually rounded. The intent of such rounding is to avoid sharp edges and minimize the hazard of failure. It was found, however, that the blade roots, which are subject to considerable loading during operation of the gas turbine, develop cracks originating at the edges or transitions of the surfaces.

In a broad aspect, the present invention provides for a gas-turbine blade root of the type specified at the beginning above, which is characterized by simple structure combined with simple and cost-effective design, and features high strength and long service life.

Therefore, in accordance with the present invention, the transition area of the surfaces is provided with a bevelled, plane edge. Such a bevelled, plane edge is mechanically simply and reproducibly manufacturable. Here, the width of the bevelled, plane edge, or the strip-like surface formed by the plane edge, is exactly dimensionable and adaptable to the mechanical loads occurring. This enables reproducible and equal geometrical conditions to be produced in all areas of the gas-turbine blade root. The disadvantage of the state of the art, namely variations in work execution and dependence on the skill of the worker, is thus excluded. Rather, it can be ensured by suitable measures that equal geometrical conditions, and thus equal loading, exist over the entire length of the edge during operation of the gas turbine. This considerably reduces the hazard of failure.

The bevelled, plane edge is preferably oriented at an angle of 45° to the respective adjoining surfaces, resulting, at the two transition areas, in an angle of 135° between the bevelled, plane edge and the surface which, as it is an obtuse angle, will not lead to an increase in mechanical load and, in particular, will not incur any stress peaks.

The transition between the adjoining surfaces and the bevelled, plane edge, as well as the edge and the surfaces, can be polished. Other types of surface treatment can also be used without departing from the inventive concept.

Figure 2:
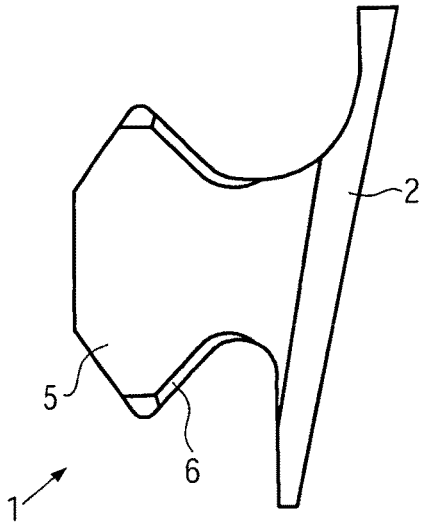
Figure 3:
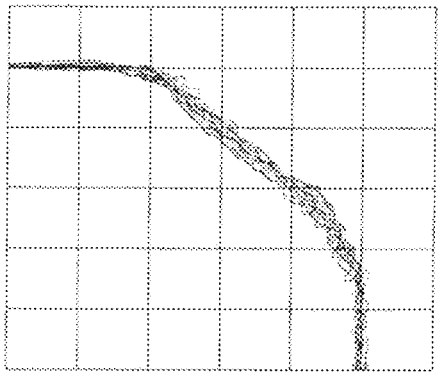
Figure 4:
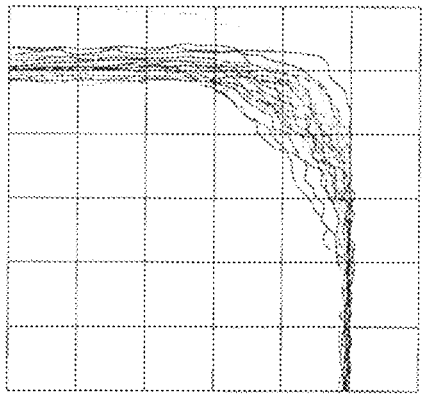
Figure 5:
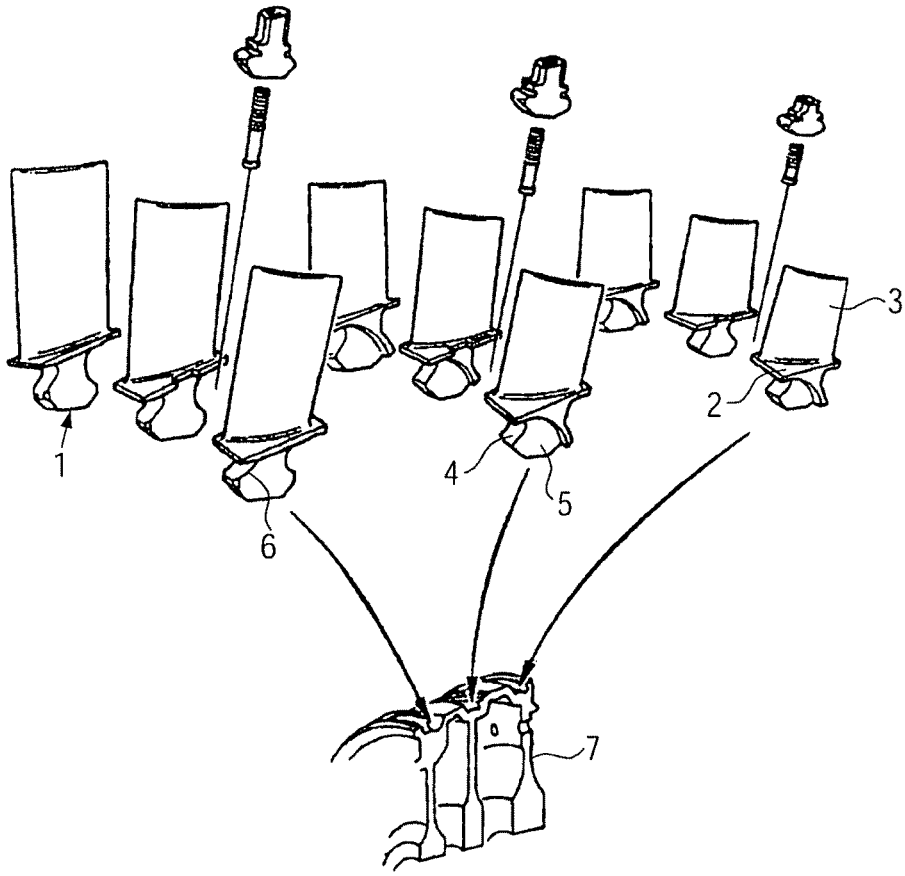

The present invention is more fully described in light of the accompanying drawings showing a preferred embodiment. In the drawings, FIG. 1 is a perspective partial representation of a gas-turbine blade root according to the present invention, FIG. 2 is a simplified side view of a gas-turbine blade root, FIG. 3 is a graphical representation of the geometry resulting from the present invention, FIG. 4 is a graphical representation, analogically to FIG. 3, of the geometry resulting from the state of the art, and FIG. 5 is a perspective representation in highly simplified form of the allocation of the gas-turbine blade root according to the present invention.

The Figures show a gas-turbine blade root 1 with adjoining platform 2 extending into a blade or airfoil portion 3. The designs correspond to the state of the art and are most variedly adaptable to the respective requirements. FIG. 5 very schematically depicts the contour of the gas-turbine blade root 1 and its fixation in a disk 7.

Figure 1:
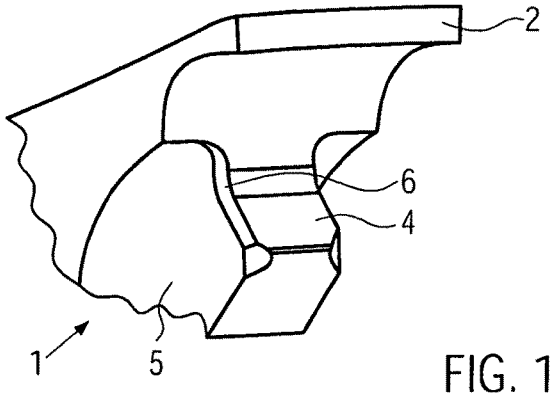

Depicted in FIG. 1 are two adjoining surfaces 4, 5 which are essentially rectangular (or normal) to each other and include, at their transition area, a bevelled, plane edge 6 with defined width according to the present invention. These design features also become apparent from FIG. 2 showing a side view of the arrangement of FIG. 1.

As becomes apparent, the bevelled, plane edge 6 has constant width and is reproducibly manufacturable. This also becomes apparent from the representation of FIG. 3. The latter shows that the geometrical dimensions vary within a very small range only, even at strong magnification and with roughness being taken into account. In contrast, the rounded edge according to the state of the art (see FIG. 4) shows considerable scatter. This results in severely varying mechanical loads (in particular stress peaks) which may lead to failure of the gas-turbine blade root.

List of Reference Numerals

1 Blade root
2 Platform
3 Blade
4, 5 Surface
6 Plane edge
7 Disk

What is claimed is:

1. A gas-turbine rotor comprising:

a blade disk having a center axis to coincide with a longitudinal axis of a gas-turbine and a circumferential slot with a radially inwardly facing surface, the circumferential slot extending around at least a majority of a circumference of the blade disk;

a rotor blade having a blade root positioned in the circumferential slot;

first and second adjoining surfaces positioned on the blade root locating the blade root in the circumferential slot, the first adjoining surface being substantially parallel to the center axis of the blade disk and the second adjoining surface being aligned to be essentially normal to a plane formed by the center axis and radius extending through the center axis and a center of the blade root, the second adjoining surface also being essentially normal to the adjoining surface ; and a stress-relieving transition area positioned between the first and second adjoining surfaces shaped as a beveled, plane edge;

the second adjoining surface facing radially outwardly and engaging the radially inwardly facing surface of the blade disk to radially locate and retain the blade root in the blade disk;

wherein the edge has an essentially constant width over its entire surface;

wherein the edge is oriented at an angle of essentially 45°to the respective adjoining surfaces.

2. The gas-turbine rotor of claim 1, wherein the edge is of a strip-type design.

3. The gas-turbine rotor of claim 2, wherein the edge is polished.

4. The gas-turbine rotor of claim 3, wherein the surfaces are polished.

5. The gas-turbine rotor of claim 4, wherein the edge is provided on the entire transition area.

6. The gas-turbine rotor of claim 4, wherein the edge is provided on only a portion of the transition area.

7. The gas-turbine rotor of claim 1, wherein the edge is provided on the entire transition area.

8. The gas-turbine rotor of claim 1, wherein the edge is provided on only a portion of the transition area.

9. The gas-turbine rotor of claim 1, wherein the rotor blade includes an airfoil connected to the blade root and a blade platform positioned between the blade root and the airfoil.

10. The gas-turbine rotor of claim 5, wherein the rotor blade includes an airfoil connected to the blade root and a blade platform positioned between the blade root and the airfoil.

11. The gas-turbine rotor of claim 6, wherein the rotor blade includes an airfoil connected to the blade root and a blade platform positioned between the blade root and the airfoil.

12. A method for manufacturing a gas rotor comprising:

providing a blade disk having a center axis to coincide with a longitudinal axis of a gas-turbine and a circumferential slot with a radially inwardly facing surface, the circumferential slot extending around at least a majority of a circumference of the blade disk;

providing a rotor blade having a blade root positioned in the circumferential slot;

providing first and second adjoining surfaces positioned on the blade root for locating the blade root in the circumferential slot. the first adjoining surface being substantially parallel to the center axis of the blade disk and the second adjoining surface being aligned to be essentially normal to a plane formed by the center axis and a radius extending through the center axis and a center of the blade root, the second adjoining surface also being essentially normal to the first adjoining surface; and providing a stress-relieving transition area positioned between the first and second adjoining surfaces shaped as a beveled, plane edge;

providing that the second adjoining surface is facing radially outwardly and engaging the radially inwardly facing surface of the blade disk to radially locate and retain the blade root in the blade disk;

providing equal mechanical loading and reducing mechanical stress peaks along an entire length of the edge during operation of the gas-turbine rotor by manufacturing the edge to be exactly dimensioned and have an essentially constant width over its entire surface;

providing that the edge is oriented at an angle of essentially 45°to the respective adjoining surfaces.

* * * * *